US010398923B2

(12) United States Patent
Hur

(10) Patent No.: US 10,398,923 B2
(45) Date of Patent: Sep. 3, 2019

(54) ADJUSTABLE RESISTANCE BAND AND SYSTEM INCLUDING SAME

(71) Applicant: Kyoung Man Hur, Budd Lake, NJ (US)

(72) Inventor: Kyoung Man Hur, Budd Lake, NJ (US)

( * ) Notice: Subject to any disclaimer, the term of this patent is extended or adjusted under 35 U.S.C. 154(b) by 356 days.

(21) Appl. No.: 15/449,369

(22) Filed: Mar. 3, 2017

(65) Prior Publication Data

US 2018/0250544 A1 Sep. 6, 2018

(51) Int. Cl.
*A63B 21/00* (2006.01)
*A63B 21/04* (2006.01)
*A63B 23/035* (2006.01)

(52) U.S. Cl.
CPC ..... *A63B 21/0407* (2013.01); *A63B 21/4035* (2015.10); *A63B 23/03516* (2013.01)

(58) Field of Classification Search
None
See application file for complete search history.

(56) References Cited

U.S. PATENT DOCUMENTS 4,852,874 A * 8/1989 Sleichter, III ..... A63B 21/0004 482/122
5,308,305 A 5/1994 Romney
5,681,248 A * 10/1997 Vani ..... A63B 21/0004 482/10
5,727,254 A * 3/1998 Dicker ..... A41D 13/0015 2/115
5,860,896 A * 1/1999 Mann ..... A61F 5/026 482/121
6,244,998 B1 * 6/2001 Hinds ..... A63B 21/0004 482/124
6,645,128 B1 11/2003 Hur
6,659,921 B2 * 12/2003 Vernon ..... A63B 21/0442 482/114
7,931,572 B1 * 4/2011 Glauser ..... A63B 21/0004 482/126
7,935,036 B2 5/2011 Haynes
8,317,662 B2 * 11/2012 Siipola ..... A63B 49/035 482/49
8,317,667 B1 * 11/2012 Thomas ..... A63B 21/0555 482/121
8,562,494 B2 * 10/2013 Thomas ..... A63B 21/0555 482/121
9,242,137 B1 * 1/2016 Hoffman ..... A63B 21/1645
2002/0187884 A1 * 12/2002 McGrath ..... A63B 21/0552 482/121

(Continued)

*Primary Examiner* — Stephen R Crow
(74) *Attorney, Agent, or Firm* — Birch, Stewart, Kolasch & Birch, LLP

(57) ABSTRACT

A resistance band is provided that includes a flexible band having a first side and a second side, a first handle located at the first side of the flexible band, a second handle located at the second side of the flexible band, and a base member located between the first handle and the second handle, the flexible band passing through the base member, the base member including at least one fastener configured to connect the base member to another exercise device. An exercise system is also provided that includes the resistance band and the exercise device having at least one fastener configured to cooperate with the at least one fastener of the resistance band.

12 Claims, 12 Drawing Sheets

(56) References Cited

U.S. PATENT DOCUMENTS

| | | | | |
|---|---|---|---|---|
| 2005/0043154 | A1* | 2/2005 | Atrizadeh | A63B 21/0004 482/124 |
| 2005/0261113 | A1* | 11/2005 | Wilkinson | A63B 21/0004 482/124 |
| 2005/0271857 | A1* | 12/2005 | Brody | A63B 21/0004 428/78 |
| 2007/0287616 | A1* | 12/2007 | Weaver | A63B 21/0004 482/124 |
| 2013/0331241 | A1 | 12/2013 | Spina | |
| 2014/0373247 | A1* | 12/2014 | Swaby | A63B 71/14 2/69 |
| 2015/0005141 | A1 | 1/2015 | Krahling | |
| 2016/0023080 | A1* | 1/2016 | Gregory | A63B 69/0059 473/438 |

* cited by examiner

ADJUSTABLE RESISTANCE BAND AND SYSTEM INCLUDING SAME

BACKGROUND OF THE INVENTION

Field of the Invention

The present specification relates generally to a resistance band having a connection mechanism capable of cooperating with one or more exercise devices wearable by a user to provide multiple exercise options, and a system including the resistance band and the one or more exercise devices wearable by the user.

Description of Related Art

Resistance bands are known in the art. Typically these resistance bands include one end having a connector to connect to a stationary object and a second end graspable by a user. During use, the second end is moved in a direction away from the stationary object and against resistance provided by the resistance band to perform one or more different exercises. Depending on the type of handle attachment, one end of the resistance band may extend through the handle and be secured by a plug or other mass inserted into the resistance band to keep it from pulling back through the handle.

Because of the foregoing configuration, multiple resistance bands are necessary to work both arms simultaneously. In addition, due to the repeated stretching motion of the resistance bands, the strength of the resistance band may decrease over time.

BRIEF SUMMARY OF THE INVENTION

Accordingly, it is an object of the present invention to provide a resistance band which eliminates the above problems encountered with conventional resistance bands.

Another object of the present invention is to provide an improved resistance band that may work with different exercise devices that may be worn by a user.

According to an aspect of the present invention, a resistance band is provided that includes a flexible band having a first side and a second side, a first handle located at the first side of the flexible band, a second handle located at the second side of the flexible band, and a base member located between the first handle and the second handle, the flexible band passing through the base member, the base member including at least one fastener configured to connect the base member to another exercise device.

According to another aspect of the present invention, the at least one fastener is a pair of fasteners and may take the form of snap buttons.

According to a different aspect of the present invention, the flexible band is formed to make a loop where opposite ends of the flexible band are joined by a connector. Alternatively, the flexible band may be formed by joining a first flexible band to a second flexible band with a pair of connectors to provide a loop.

According to yet another aspect of the present invention, the resistance band may include a first pad located between the first handle and the base member and a second pad located between the second handle and the base member.

According to still another aspect of the claimed invention, the flexible band may have a first end and second end and the resistance band may include a locking member to secure the first end of the flexible band and the second end of the flexible band at the base member. Each of the first end of the flexible band and the second end of the flexible band may be provided with a connector and the locking member may include a central slot configured to retain the first end of the flexible band and the second end of the flexible band via the respective connectors. The connectors may be provided in plurality to allow for adjustment in useable length of the flexible band.

According to a different aspect of the present invention, an exercise system is provided that may include a resistance band as described above and an exercise device having at least one fastener configured to cooperate with the at least one fastener of the resistance band. The exercise device may be an exercise belt to be worn around a waist of a user or may be a neck exercise device. The neck exercise device may include a head strap having a first end and a second end, a first flexible band having a first end connected to the first end of the head strap and second end, a second flexible band having a first end connected to the second end of the head strap and a second end, and a base member located between the first ends and second ends of the first and second flexible bands, the base member including the at least one fastener of the exercise device.

Further scope of applicability of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
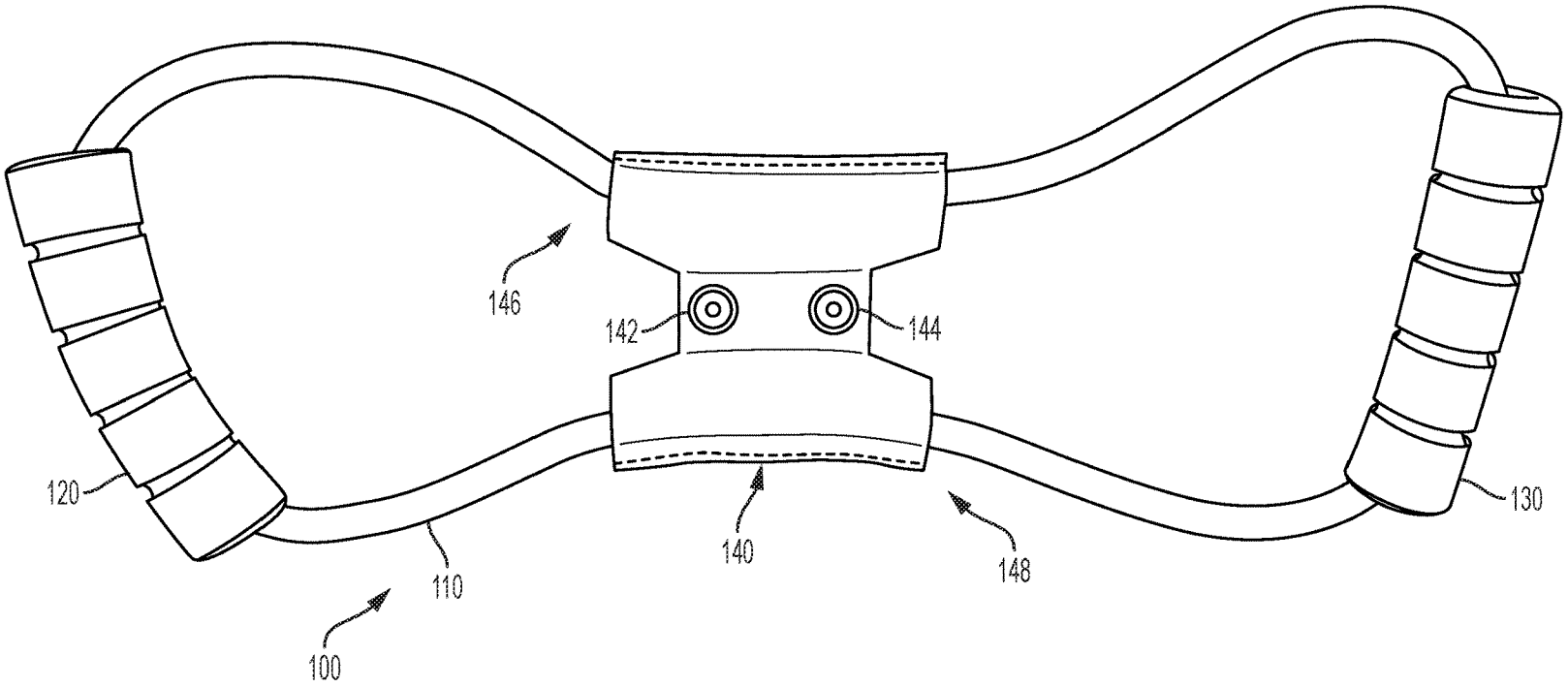
FIG. 1 is a front view of a resistance band according to a first exemplary embodiment of the present invention.
Figure 2:
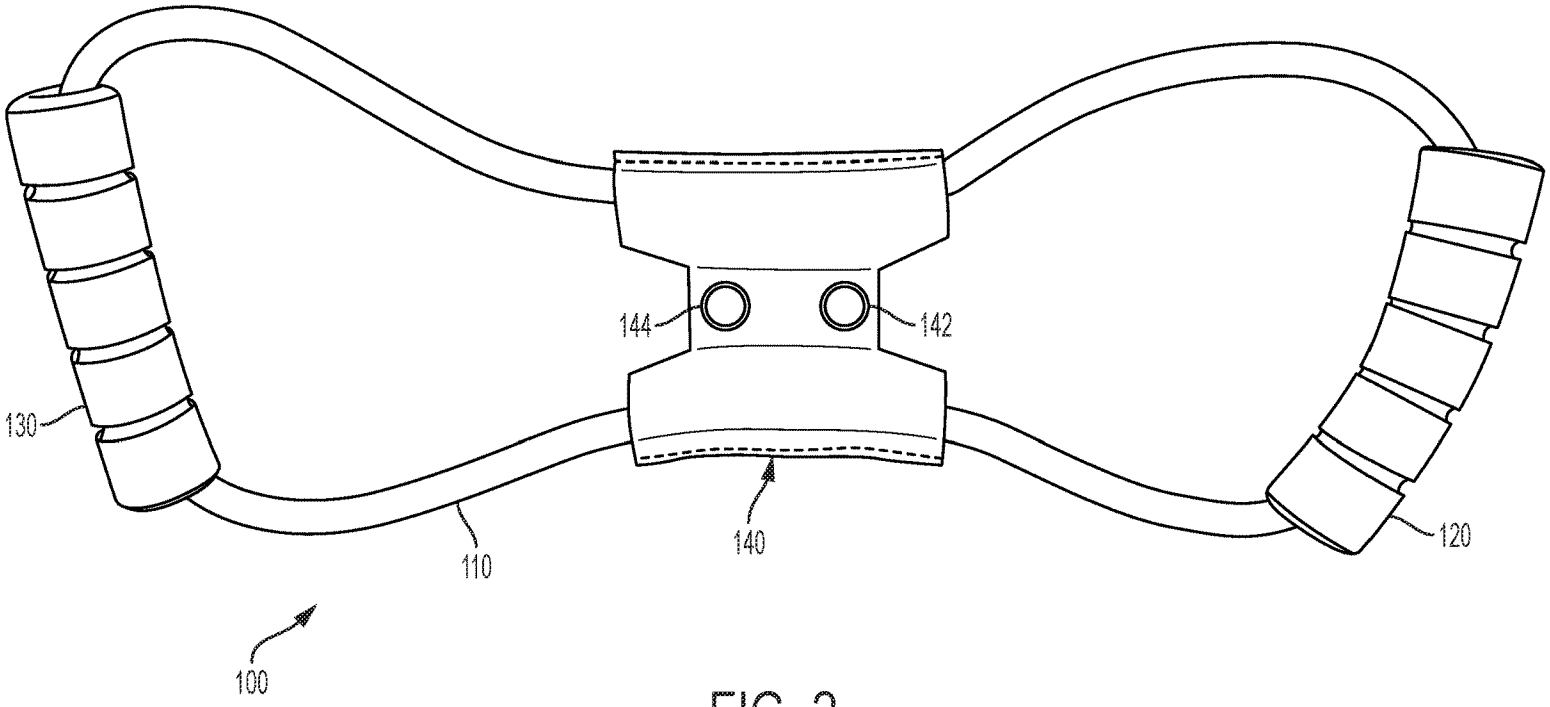
FIG. 2 is a rear view of the resistance band of FIG. 1.

Referring now in detail to the drawings for the purpose of illustrating exemplary embodiments of the present invention, an exercise device shown in FIGS. 1 and 2 comprises a resistance band 100 which includes a flexible band 110 formed in a shape of a loop, a first handle 120 at one side of the loop, a second handle 130 at another side of the loop, and a base member 140 located between the first and second handles 120, 130. The base member 140 includes fasteners 142, 144 that are used to connect the resistance band 100 to one or more different exercise devices, which will be described in greater detail below.

The flexible band 110 may be made of latex or other conventional materials used for resistance bands. Depending on the intended use of the resistance band 100, the material may be selected to provide a predetermined resistance to stretching.

Each of the handles 120, 130 may be made of foam material or other suitable material to provide a comfortable grip for a user. As shown in this exemplary embodiment, the handles 120, 130 have ribbed segments to provide greater flexibility in bending; however, it is understood that the handles may be smooth or have other contours.

The base member 140 includes an upper portion 146 and lower portion 148, each of which has a through passage for the flexible band to extend through. In this manner, the base member may be located centrally between the first and second handles 120, 130. The base member 140 may be made of two leather pieces sewn together; however, other appropriate materials may be used. In this exemplary embodiment, the fasteners 142, 144 are snap buttons; however, it is understood that other types of fasteners including other types of buttons or hook-and-loop fasteners can be used.

Figure 3:
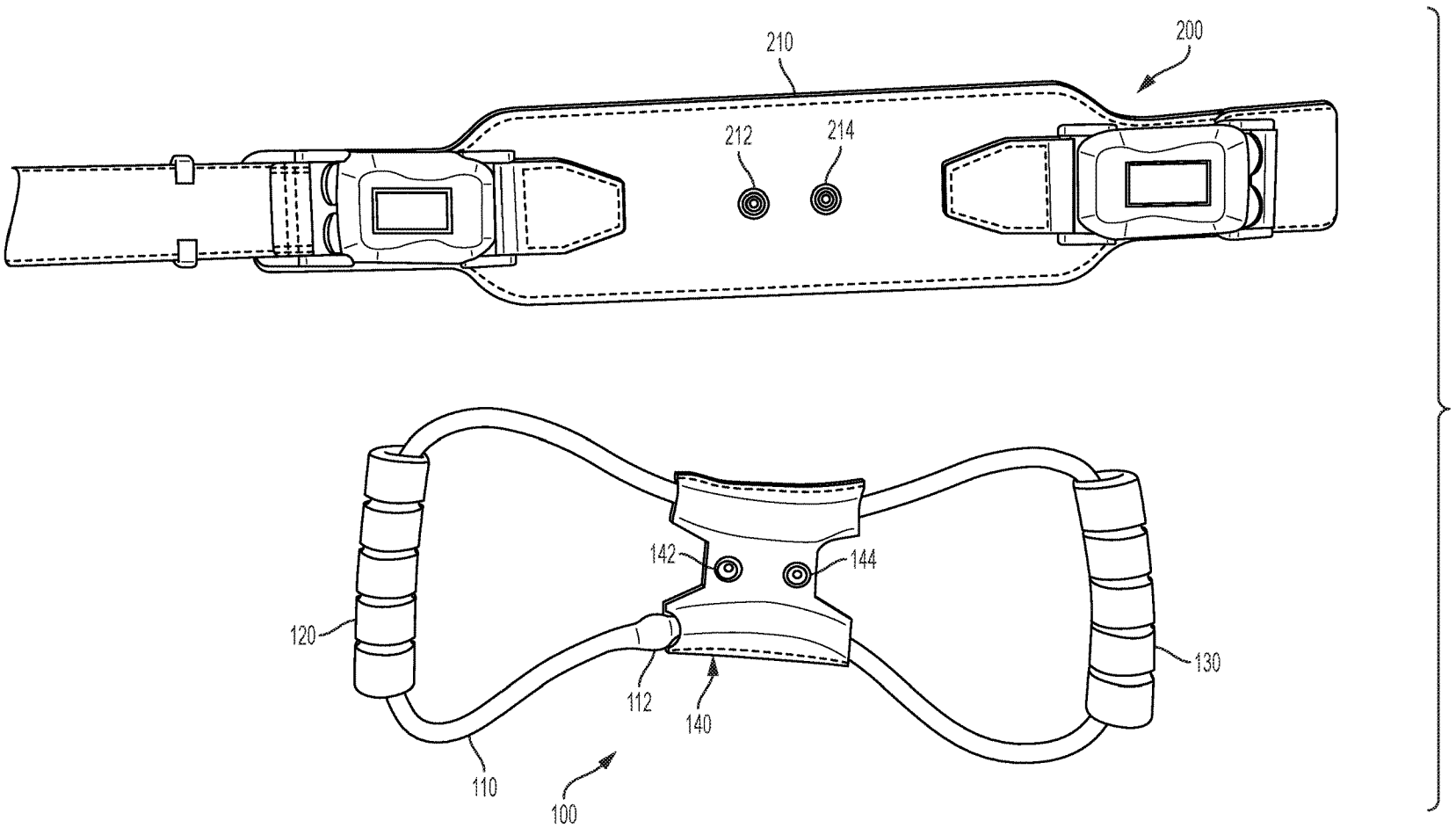
FIG. 3 is a plan view of an exercise belt useable with the resistance band of FIG. 1.
Figure 4:
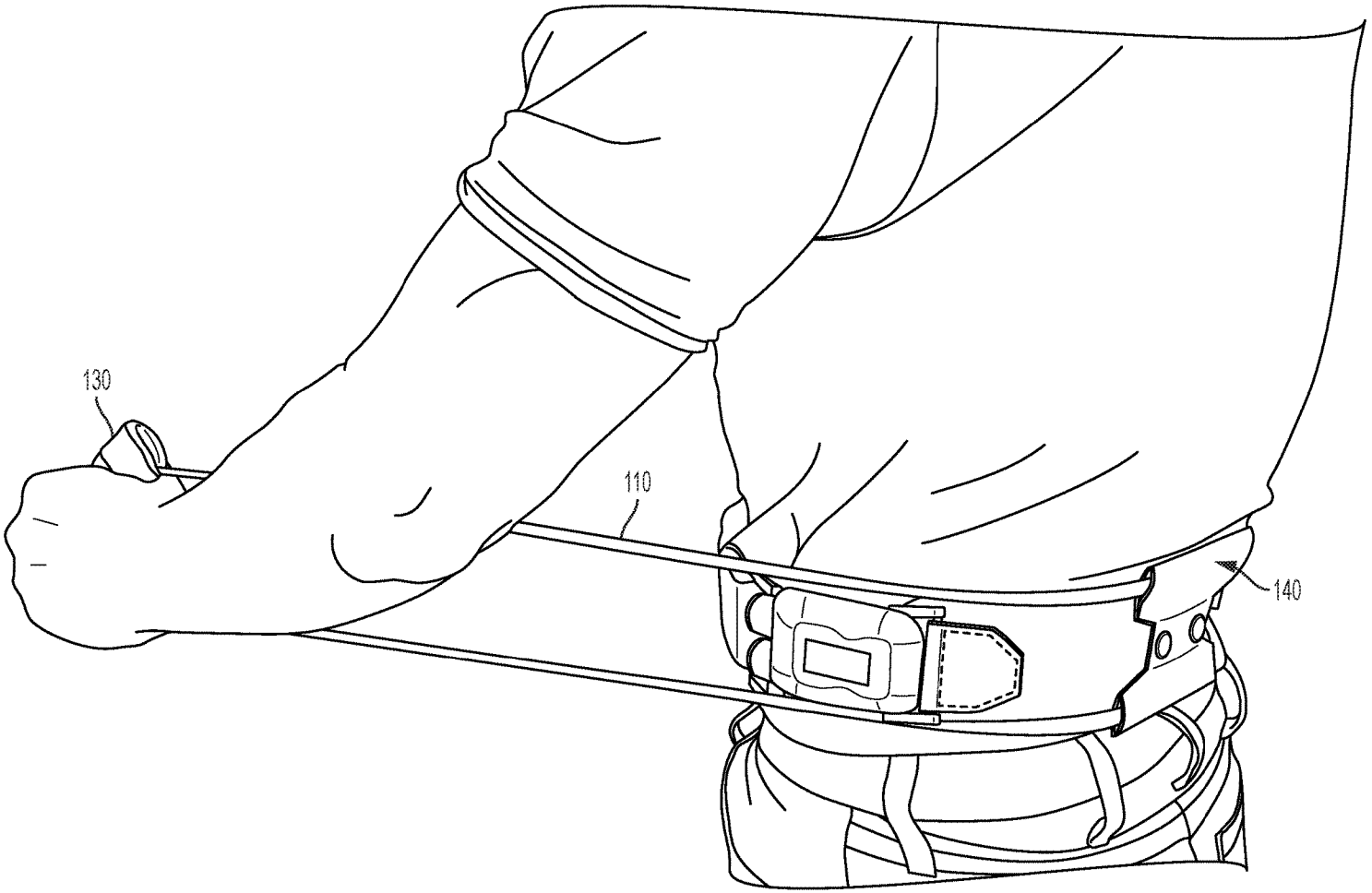
FIG. 4 is a perspective view of the resistance band of FIG. 1 connected to the exercise belt and worn by a user.

As shown in FIGS. 3 and 4, the resistance band 100 can be used with an exercise belt 200. The exercise belt 200 includes a main panel 210 and fasteners 212, 214 provided on the main panel. The exercise belt 200 may take the form of a weight belt or a belt intended to be used to perform abdominal muscle exercises. One example of such an exercise belt is described in U.S. Pat. No. 6,645,128, which is hereby incorporated by reference. In this exemplary embodiment, the fasteners 212, 214 are snap buttons; however, it is understood that other types of fasteners including other types of buttons or hook-and-loop fasteners can be used to match the fasteners 142, 144 of the resistance band 100.

As also seen in FIG. 3, the flexible band 110 may be formed in a loop by joining two ends of the flexible band 110 together around a connector 112, which may take the form of a plug or other solid mass, similar to those used in conventional resistance bands to connect a handle to a free end of the resistance band. That is, in the exemplary embodiment, both ends of the flexible band surround the connector 112 so as to provide a loop after being fed through the base member 140.

In order to use the resistance band 100 with the exercise belt 200, a user connects the fasteners 142, 144 of the resistance band 100 to the fasteners 212, 214 of the exercise belt 200. This may be done before or after the user puts on the exercise belt 200. Once the resistance band 100 is attached to the exercise belt 200, the user grasps the handles 120, 130 and extends his or her arms to perform an exercise move. Depending on the type of the exercise belt 200, the arms and the abdominal muscles may be worked at the same time. In addition to actively using the resistance band for exercise, a user can also use the resistance band 100 in combination with the exercise belt 200 to improve posture when sitting in a chair by placing each of the handles 120, 130 around a corresponding arm of the chair.

Figure 5:
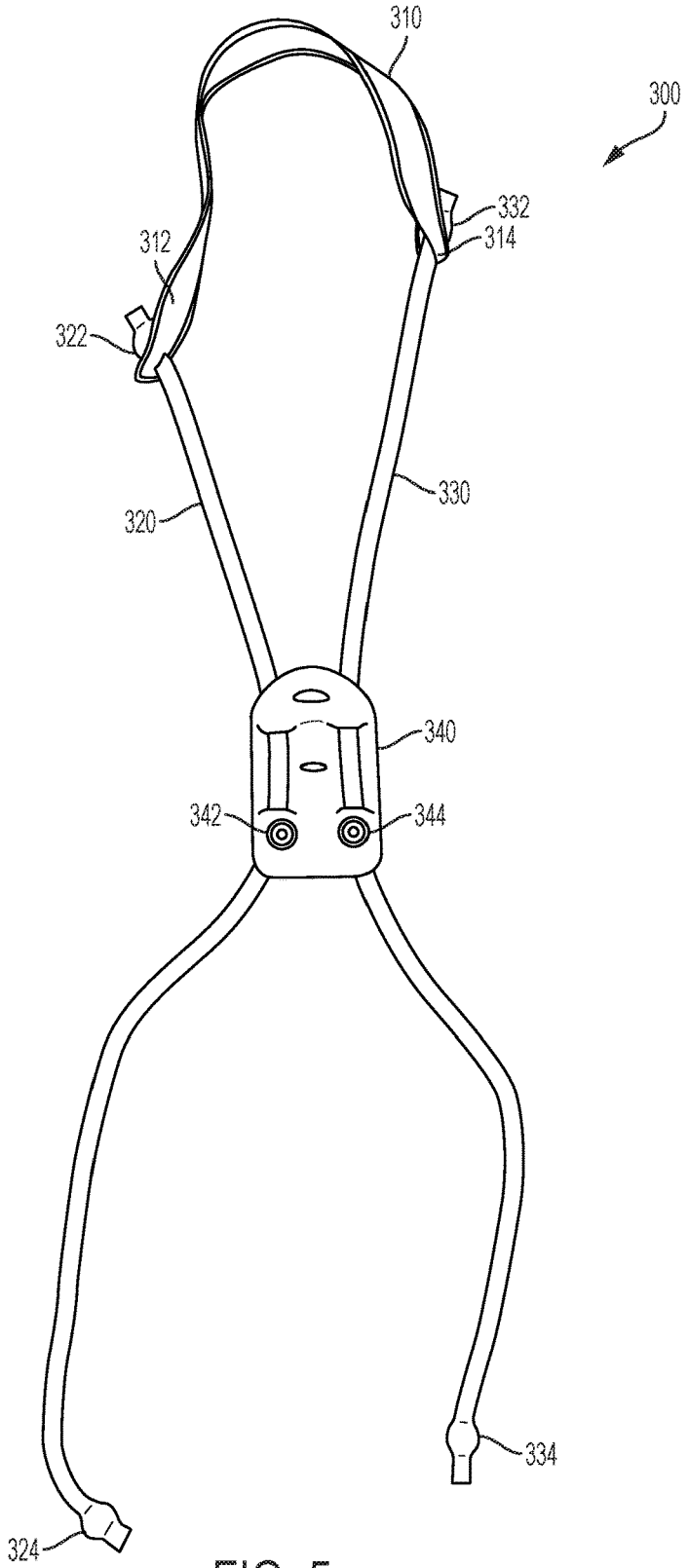
FIG. 5 is a view of a neck exercising accessory connectable to the resistance band of FIG. 1.
Figure 6:
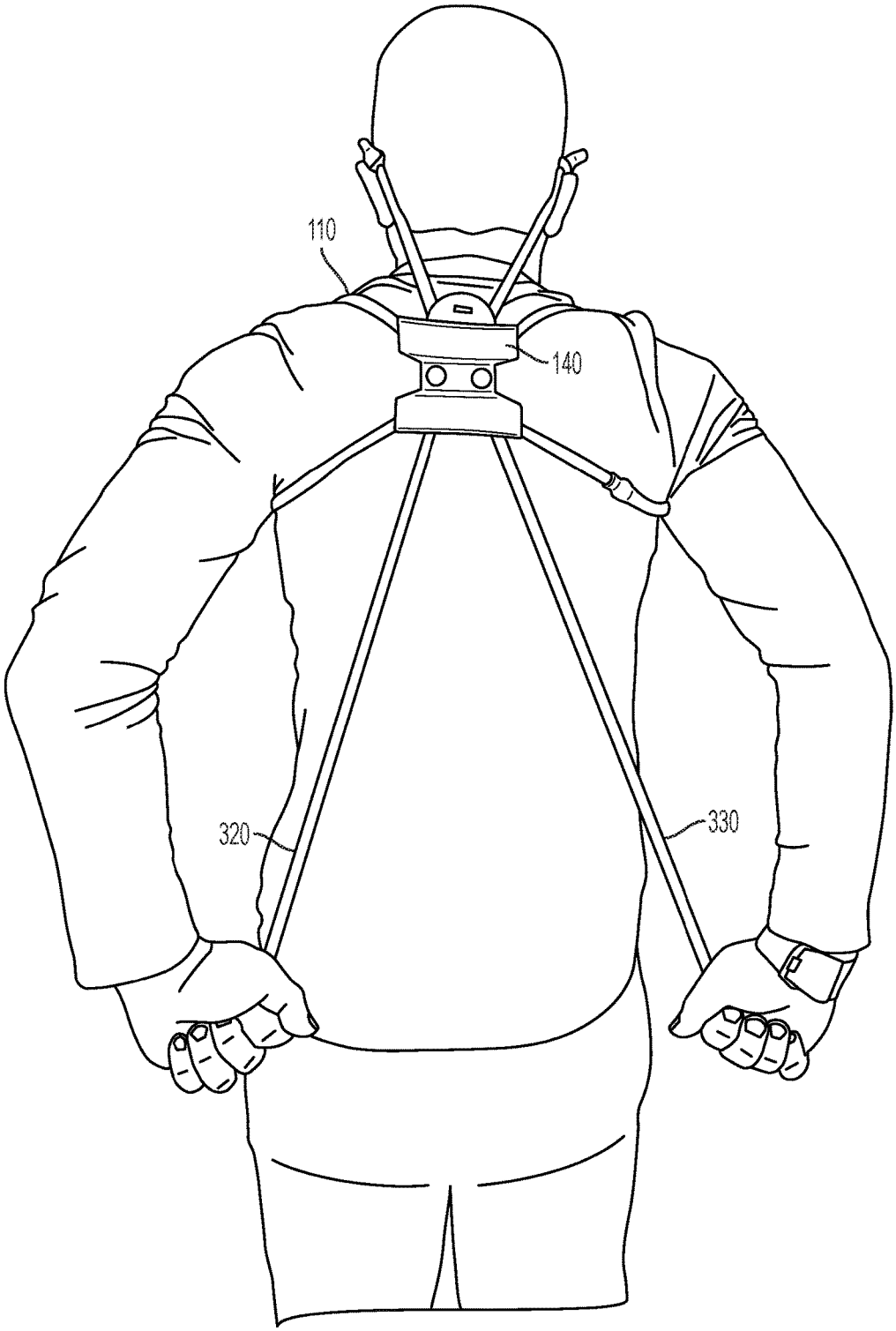
FIG. 6 is a rear view of the neck exercising accessory of FIG. 5 connected to the resistance band of FIG. 1 and worn by a user.
Figure 7:
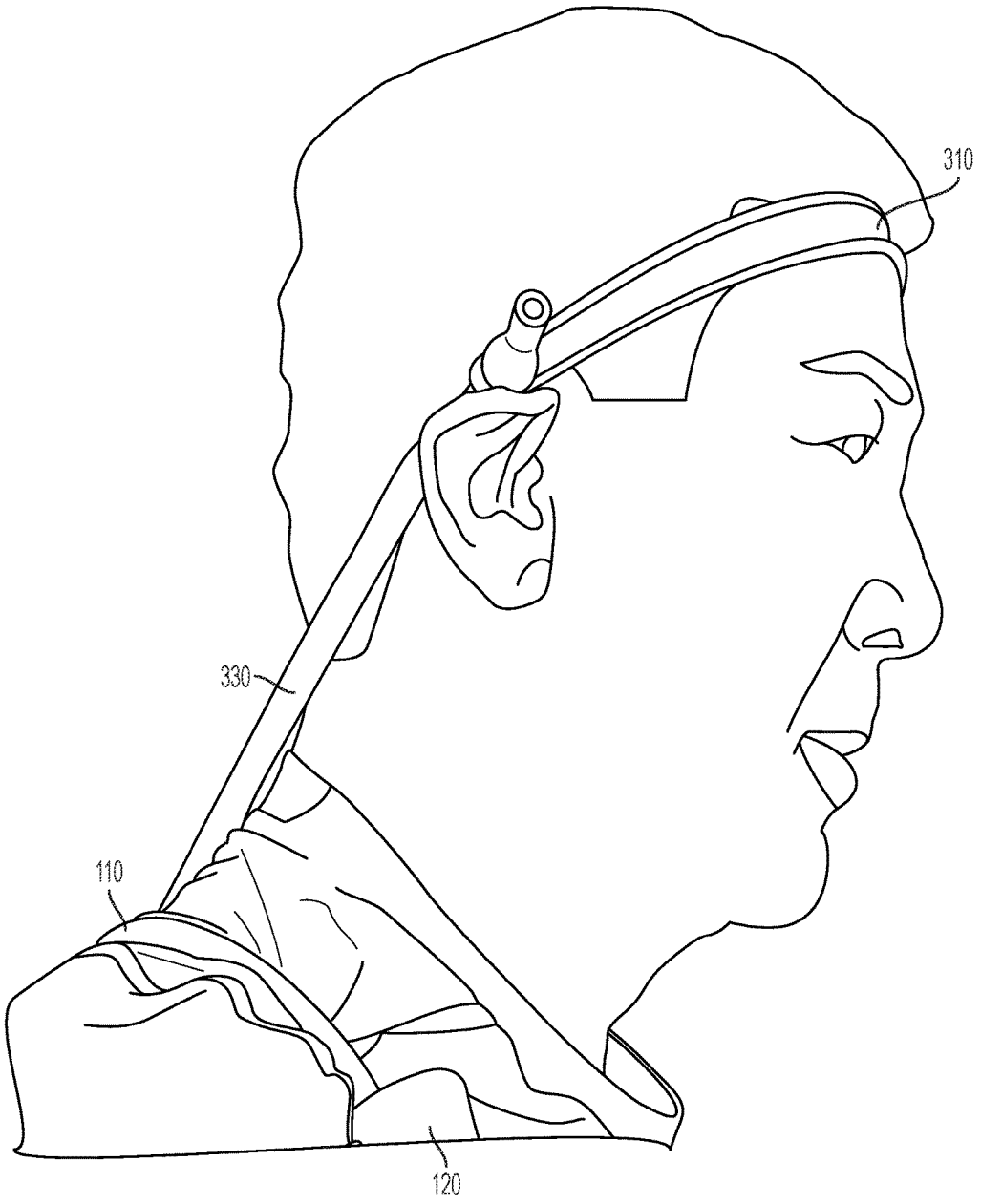
FIG. 7 is a side view of the combination of the neck exercising accessory and resistance band of FIG. 6.

Referring now to FIGS. 5 to 7, the resistance band 100 can be used in combination with a neck exercising device 300. As shown in FIG. 5, the neck exercising device 300 includes a head strap 310 having a first end 312 and a second end 314, a first flexible band 320 having a first end 322 joined to the first end 312 of the head strap 310 and a second end 324, a second flexible band 330 having a first end 332 joined to the second end 314 of the head strap 310 and a second end 334, and a base member 340 located between the first ends 322, 332 and the second ends 324, 334 of the first and second flexible bands 320, 330. The base member 340 includes fasteners 342, 344 configured to connect to the fasteners 142, 144 of the base member 140 of the resistance band 100.

The head strap 310 may be made of plastic or other suitable materials that comfortably fit against the head of a user. Preferably, the head strap 310 will not slip along the user's head during exercising of the neck. The head strap 310 may be connected to first ends 322, 332 of the first and second flexible bands 320, 330 using connectors similar to those described above to join ends of the flexible band 110 to each other. The flexible bands 320, 330 may be made of similar material to that of the flexible band 110. The amount of resistance to stretching of the flexible bands 320, 330 may be selected to be less than the amount of resistance to stretching of the flexible band 110 because of the different muscles to be exercised.

The base member 340 may be made of two leather pieces sewn together; however, other appropriate materials may be used. In this exemplary embodiment, the fasteners 342, 344 are snap buttons; however, it is understood that other types of fasteners including other types of buttons or hook-and-loop fasteners can be used. In this exemplary embodiment, the base member 340 is provided with through holes so that the first and second flexible bands 320, 330 can extend through the base member 340, thereby allowing the base member 340 to be repositioned relative to the head strap 310.

As shown in FIGS. 6 and 7, in order to use the resistance band 100 with the neck exercise device 300, a user connects the fasteners 142, 144 of the resistance band 100 to the fasteners 342, 344 of the neck exercise device 300. Then, resistance band 100 is worn around the shoulders of the user by placing the user's arms between the handles 120, 130 and the base member 140. The head strap 310 is placed over the head of the user and the second ends 324, 334 of the flexible bands 320, 330 are grasped by the user to provide tension in the flexible bands 320, 330. After grasping the second ends 324, 334 of the flexible bands 320, 330, the user may flex his or her neck against the tension provided in the flexible bands 320, 330 to exercise his or her neck.

By wearing the resistance band 100 around the shoulders at the same time that the neck exercise device 300 is used, the resistance band 100 can also act as a chest expander. In addition, the combination of the resistance band 100 and neck exercise device 300 can be worn while sitting to improve posture. Alternatively, the resistance band can be worn alone while sitting to improve posture.

The resistance band 100 can be worn around the shoulders without the neck device during exercise to expand the chest and improve breathing. For example, the resistance band 100 can be worn during jogging, running, rowing or other cardiovascular exercises. During these types of exercise, a user can attach a telephone case or a flashing light to the base member 140 by slipping a clip of the telephone case or the flashing light onto to the base member 140.

A resistance band 100' according to a second exemplary embodiment of the present invention is shown in FIGS.

8-10. This second exemplary embodiment of the resistance band 100' is similar to the first exemplary embodiment disclosed above and, therefore, the differences between the first exemplary embodiment and the second exemplary embodiment will be discussed below.

The resistance band 100' includes a flexible band 110', a first handle 120' at one side of the flexible band 110', a second handle 130' at another side of the flexible band 110', and a base member 140' located between the first and second handles 120', 130'. The base member 140' includes fasteners 142', 144' that are used to connect the resistance band 100' to one or more different exercise devices.

Figure 8:
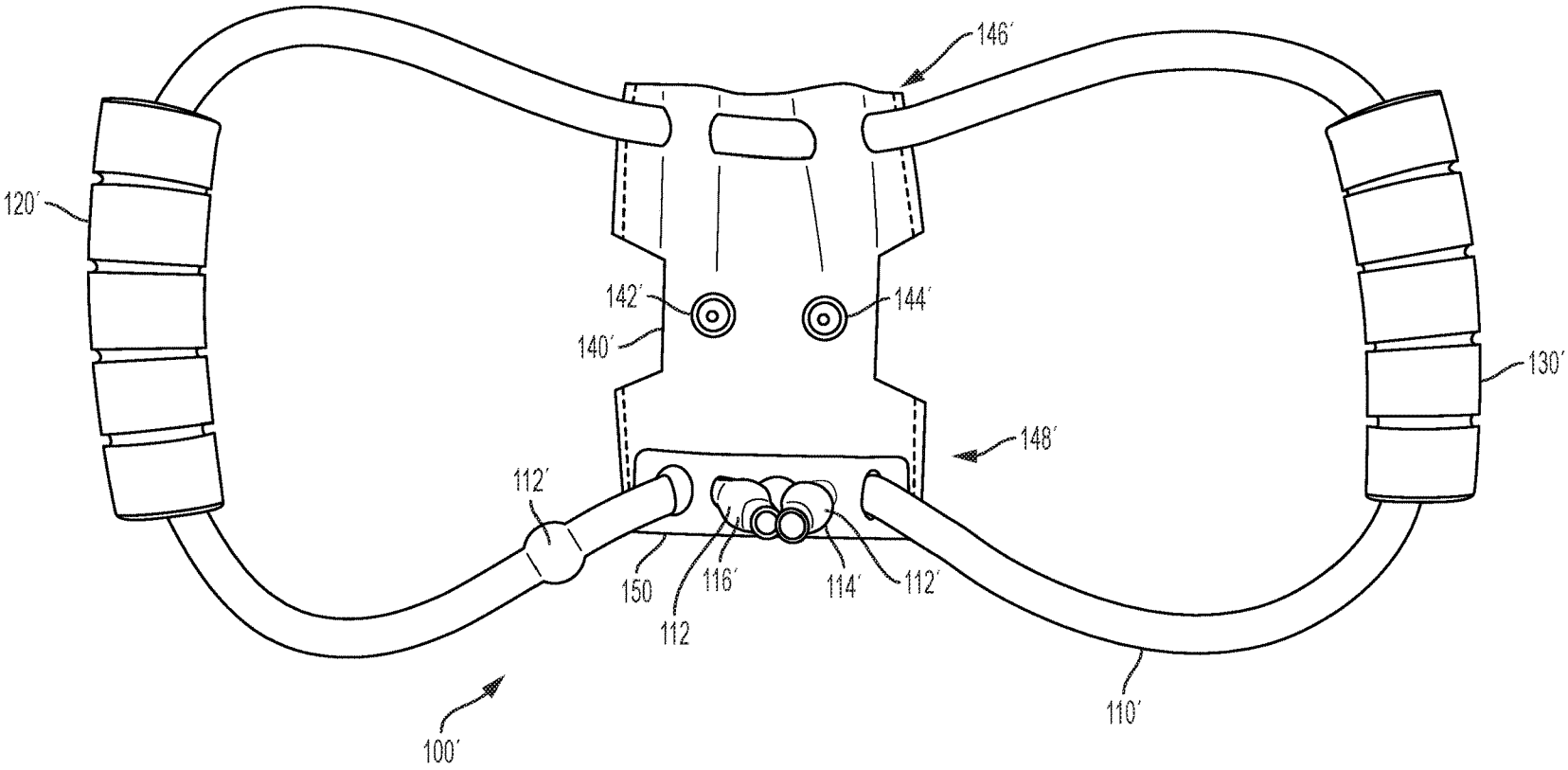
FIG. 8 is a front view of a resistance band according to a second exemplary embodiment of the present invention.
Figure 9:
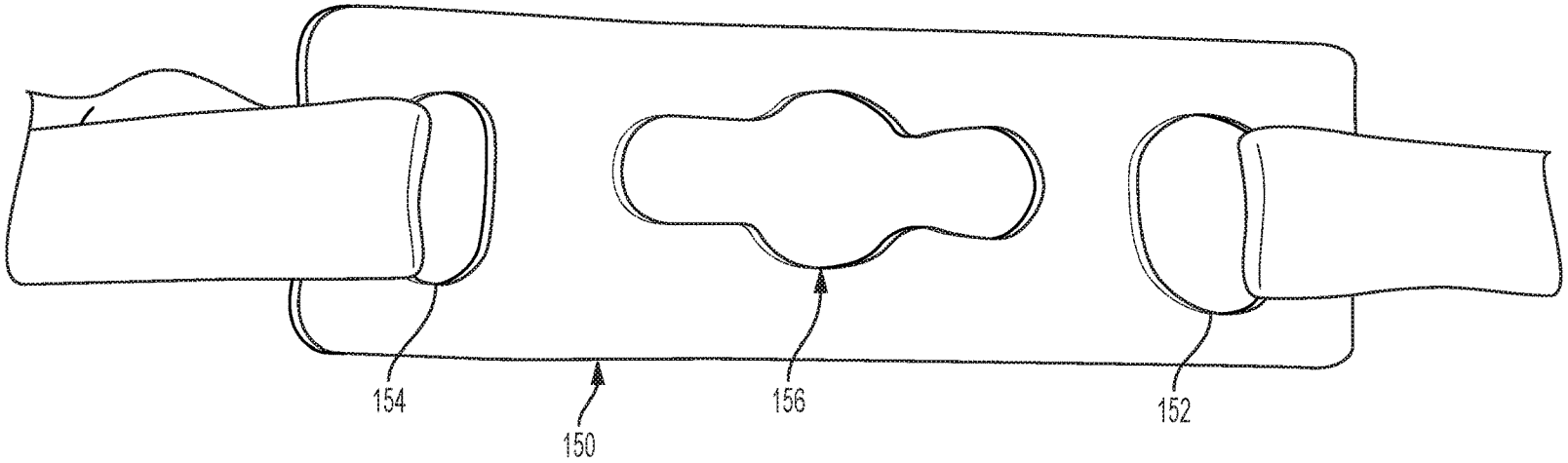
FIG. 9 is a plan view of the locking member of the resistance band of FIG. 8.

As shown in FIGS. 8 and 9, the flexible band 110' is not joined together to form a loop; rather, a first end 114' of the flexible band 110' and a second end 116' of the flexible band 110' are retained in place by a locking member 150. The locking member 150 has a planar body with first and second through holes 152, 154 formed at opposite ends of the locking member 150 and a central slot 156. In order to connect the flexible band 110' to the base member 140, the flexible band 110' is inserted to pass through a plurality of holes in the upper portion 146' of the base member 140'.

Then, the first end 114' of the flexible band 110' is inserted through the first hole 152 of the locking member 150 and a corresponding through hole provided in the lower portion 148' of the base member 140' before being inserted back through another through hole in the base member 140' and through the central slot 156. The central slot 156 includes a central portion that is larger than the ends so the first end 114' of the flexible band 110' can be inserted into the central slot and then slid towards the first hole 152 and retained in position by the connector 112'.

Finally, the second end 116' of the flexible band 110' is inserted through the second hole 154 of the locking member 150 and a corresponding through hole provided in the lower portion 148' of the base member 140' before being inserted back through another through hole in the base member 140' and through the central slot 156 before being slid towards the second hole 154 and retained in position by the connector 112'.

Figure 10:
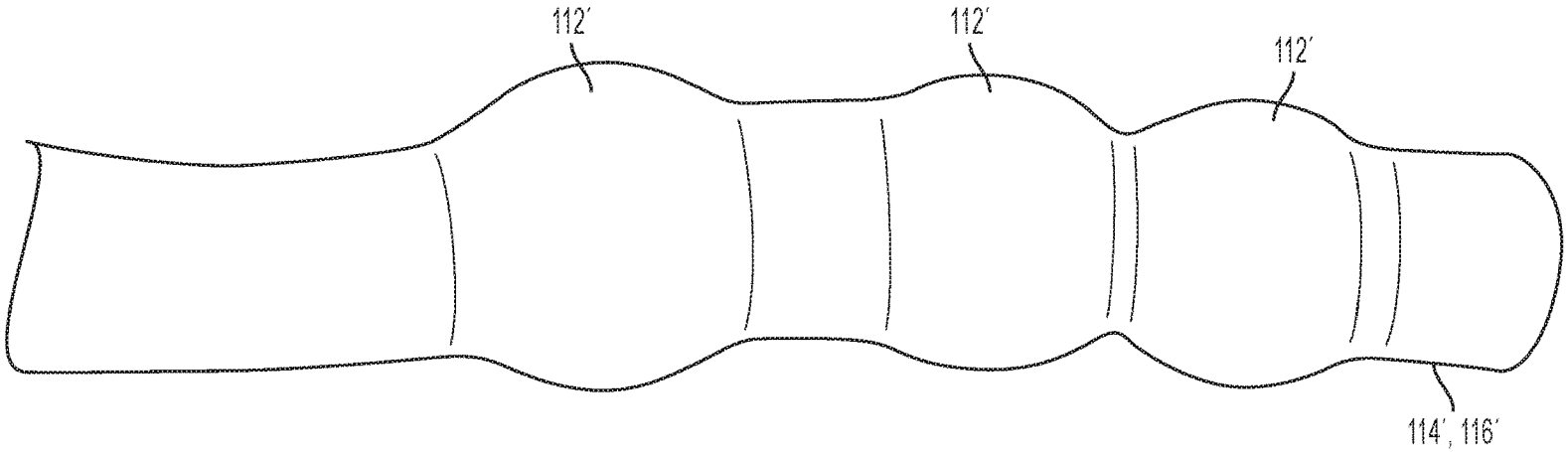
FIG. 10 is a detail view of one end of the resistance band of FIG. 8.

Once assembled, the resistance band 100' can be used in a manner similar to the resistance band 100 discussed above. Recognizing that it may be desirable to adjust the useable length of the flexible band', a plurality of connectors 112' can be inserted into the first and/or second ends 114', 116' of the flexible band 110', as shown in FIGS. 8 and 10, to allow the user to select which of the plurality of connectors 112' to use to retain the ends of the flexible band 110' by the locking member 150. For example, the user may want to adjust the useable length of the flexible band 110' depending on whether the resistance band 100' will be used with an exercise belt or worn around the shoulders. The useable length of the flexible band 110' may also be adjusted if the flexible band 110' becomes too stretched over time. For example, the first hole 152 and the second hole 154 can each permit the first end 114' and the second end 116', respectively, to be inserted such that more than one of the connectors 112' are passed therethrough, and also then passed through the central portion of the central slot 156 to be held in place by being slid back towards the first hole 152 and second hole 154, respectively. In this manner the useable length of the flexible band 110' may be adjusted to be longer or shorter depending on the number of connectors 112' that are passed through the central portion of the central slot 156.

Figure 11:
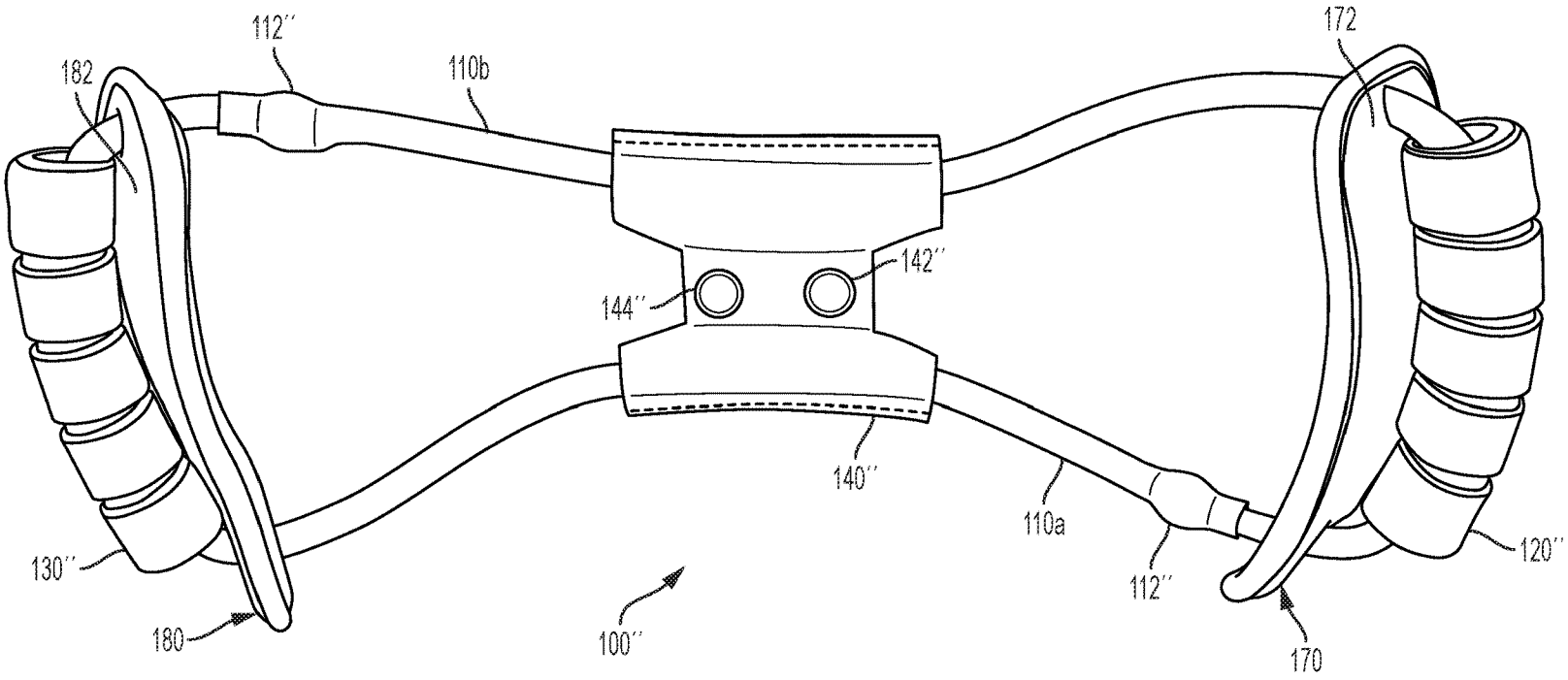
FIGS. 11 and 12 are views of a resistance band according to a third exemplary embodiment of the present invention.
Figure 12:
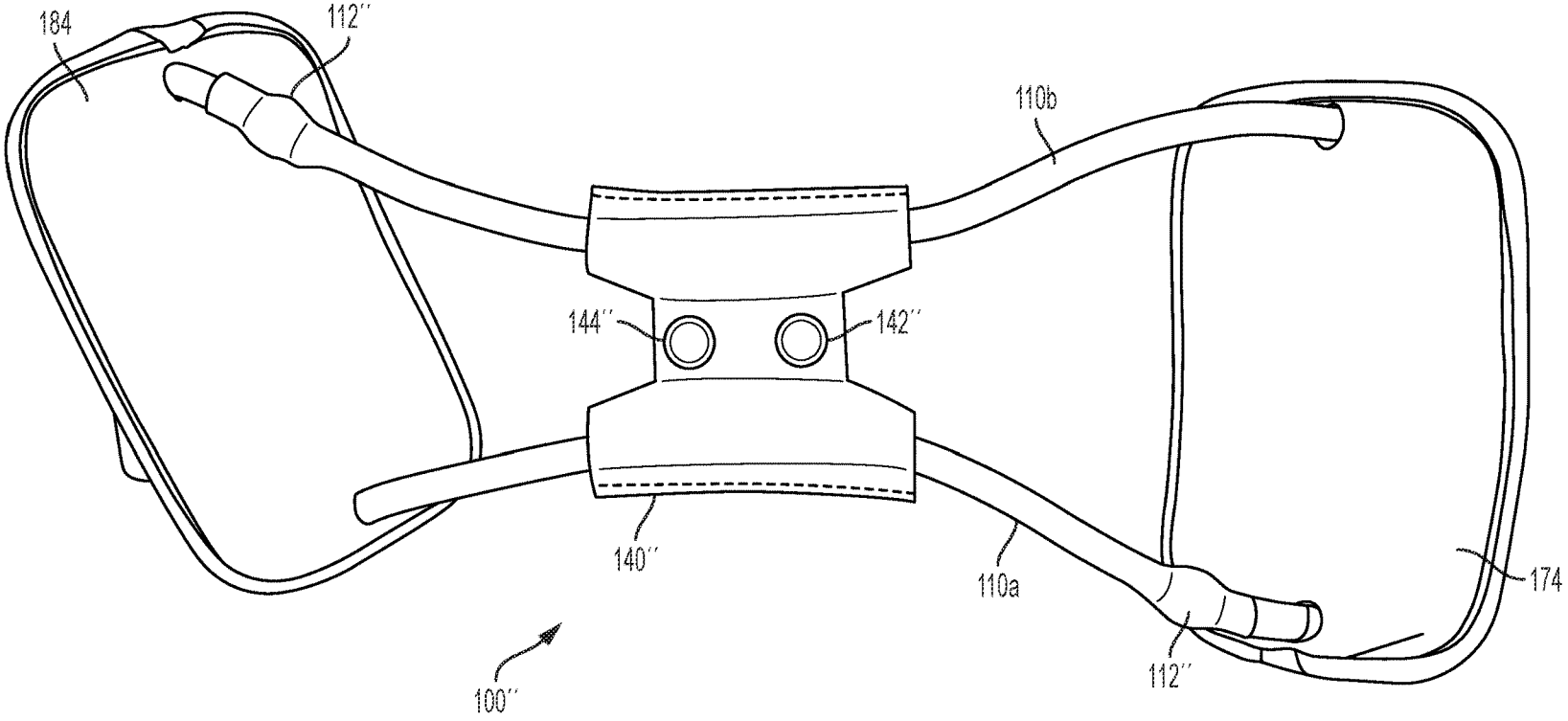

A resistance band 100" according to a third exemplary embodiment of the present invention is shown in FIGS. 11 and 12. This third exemplary embodiment of the resistance band 100" is similar to the first exemplary embodiment disclosed above and, therefore, the differences between the first exemplary embodiment and the third exemplary embodiment will be discussed below.

The resistance band 100" includes a pair of flexible bands 110*a*, 110*b* joined by connectors 112", a first handle 120" at one side of the joined flexible bands 110*a*, 110*b*, a second handle 130" at another side of the joined flexible bands 110*a*, 110*b*, and a base member 140" located between the first and second handles 120", 130". The base member 140" includes fasteners 142", 144" that are used to connect the resistance band 100" to one or more different exercise devices.

The resistance band 100" includes a first pad 170 located between the first handle 120" and the base member 140" and a second pad 180 located between the second handle 130" and the base member 140". Each of the pads 170, 180 has a first surface 172, 182 facing the respective first and second handles 120", 130" and a second surface 174, 184 facing the base member 140". Each of the pads may have an interior member made of foam or other compressible material and may have an outer layer made of a different material than the interior member.

When the resistance band 100" is worn with the neck exercise device 300 described above or separately as a chest expander, the second surfaces 174, 184 will be in contact with the user's body to provide a more comfortable fit. The first and second pads 170, 180 may help in stabilizing the location of the first and second handles 120", 130" during exercise so as to not rub on the body of the user.

While this exemplary embodiment is shown as being used with a pair of flexible bands 110*a*, 110*b*, it is understood that they could be replaced with a single joined flexible band joined in one of the manners described above regarding the first and second exemplary embodiments.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A resistance band comprising:

a flexible band having a first side and a second side;

a first handle located at the first side of the flexible band;

a second handle located at the second side of the flexible band; and a base member located between the first handle and the second handle, the flexible band passing through the base member, the base member including at least one fastener configured to connect the base member to another exercise device; wherein the at least one fastener is a pair of snap buttons.

2. The resistance band of claim 1, wherein the flexible band is formed to make a loop.

3. The resistance band of claim 2, further comprising a connector joining opposite ends of the flexible band together.

4. The resistance band of claim 1, wherein the flexible band is formed by joining a first flexible band to a second flexible band with a pair of connectors to provide a loop.

5. The resistance band of claim 1, further comprising:

a first pad located between the first handle and the base member; and a second pad located between the second handle and the base member.

6. The resistance band of claim 1, wherein the flexible band has a first end and second end, and wherein the resistance band includes a locking member to secure the first end of the flexible band and the second end of the flexible band at the base member.

7. The resistance band of claim 6, wherein each of the first end of the flexible band and the second end of the flexible band is provided with a connector, and wherein the locking member includes a central slot configured to retain the first end of the flexible band and the second end of the flexible band via the respective connectors.

8. The resistance band of claim 7, where the connectors are provided in plurality to allow for adjustment in useable length of the flexible band.

9. An exercise system comprising:

the resistance band according to claim 1; and an exercise device having at least one fastener configured to cooperate with the at least one fastener of the resistance band.

10. The exercise system of claim 9, wherein the exercise device is an exercise belt to be worn around a waist of a user.

11. The exercise system of claim 9, wherein the exercise device is a neck exercise device.

12. The exercise system of claim 11, wherein the neck exercise device includes:

a head strap having a first end and a second end;

a first flexible band having a first end connected to the first end of the head strap, and a second end;

a second flexible band having a first end connected to the second end of the head strap, and a second end; and a base member located between the first ends and second ends of the first and second flexible bands, the base member including the at least one fastener of the exercise device.

* * * * *